US007537460B2

(12) United States Patent
Millard et al.

(10) Patent No.: US 7,537,460 B2
(45) Date of Patent: May 26, 2009

(54) ELECTRICAL CONNECTOR WITH A CONTACT HAVING AT LEAST TWO CONDUCTIVE PATHS

(75) Inventors: Steven Jay Millard, Mechanicsburg, PA (US); Juli Susan Olenick, Lake Worth, FL (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/899,528

(22) Filed: Sep. 6, 2007

(65) Prior Publication Data

US 2009/0068895 A1 Mar. 12, 2009

(51) Int. Cl.
*H01R 12/00* (2006.01)

(52) U.S. Cl. ..... 439/66; 439/67; 439/91

(58) Field of Classification Search ..... 439/66, 439/67, 91, 591

See application file for complete search history.

(56) References Cited

U.S. PATENT DOCUMENTS

| | | | | |
|---|---|---|---|---|
| 4,402,562 | A * | 9/1983 | Sado | 439/91 |
| 5,096,426 | A * | 3/1992 | Simpson et al. | 439/66 |
| 6,264,476 | B1 * | 7/2001 | Li et al. | 439/66 |
| 6,712,620 | B1 * | 3/2004 | Li et al. | 439/63 |
| 7,070,420 | B1 | 7/2006 | Wakefield et al. | |
| 2005/0233610 | A1 * | 10/2005 | Tutt et al. | 439/66 |
| 2006/0286832 | A1 * | 12/2006 | Van Schuylenbergh et al. | 439/125 |

* cited by examiner

*Primary Examiner*—Briggitte R Hammond
*Assistant Examiner*—Vanessa Girardi

(57) ABSTRACT

An electrical connector includes a carrier having opposite first and second sides. A plurality of contacts are held in the carrier. Each contact includes a first conductive element defining a first conductive path and a second conductive element defining a second conductive path separate from the first conductive path. The first and second conductive paths are configured to electrically connect an electrical component on one side of the carrier to an electrical component on the opposite side of the carrier.

20 Claims, 6 Drawing Sheets

ELECTRICAL CONNECTOR WITH A CONTACT HAVING AT LEAST TWO CONDUCTIVE PATHS

BACKGROUND OF THE INVENTION

The invention relates generally to surface mounted connectors, and more specifically, to a connector that reduces the crosstalk added to signals passing through the connector.

The trend toward smaller, lighter, and higher performance electrical components and higher density electrical circuits led to the development of surface mount technology in the design of electrical systems. As is well understood in the art, surface mount packaging allows an electronic package to be attached to pads on the surface of a circuit board, either directly or through a surface mount connector, rather than by means of contacts or pins positioned in plated holes in the circuit board. Surface mount technology allows for an increased component density on a circuit board, thereby saving space on the circuit board.

In a connector, with the close proximity of contacts to one another there is a potential for crosstalk and the loss of signal integrity. As signal speeds have increased, crosstalk has become a serious issue. Some circuit boards that carry high speed signals incorporate transmission lines in the board design wherein the width of signal traces and the distance between signal and ground traces are controlled to reduce crosstalk. High speed signals propagate down a transmission line considerably better than down a stand alone trace. However, when the signal encounters a connector, the transmission line is disturbed. Typically, the benefits derived from the transmission line are not maintained as the signal moves through the connector.

A need exists for a connector that preserves signal integrity through the connector by reducing crosstalk in the connector.

BRIEF DESCRIPTION OF THE INVENTION

In one embodiment, an electrical connector is provided. The connector includes a carrier having opposite first and second sides. A plurality of contacts are held in the carrier. Each contact includes a first conductive element defining a first conductive path and a second conductive element defining a second conductive path separate from the first conductive path. The first and second conductive paths are configured to electrically connect an electrical component on one side of the carrier to an electrical component on the opposite side of the carrier.

Optionally, a plurality of polymer columns are held by the carrier with each polymer column including a first end extending from the first side of the carrier and a second end extending from the second side of the carrier. Each contact includes opposite contact ends, and each contact end includes first and second contact tips. The first conductive element extends between the first contact tips and the second conductive element extends between the second contact tips. Each contact includes an insulative layer having opposite inner and outer sides. One of the conductive elements is formed on the outer side and the other of the conductive elements is formed on the inner side.

In another embodiment, an electrical connector includes a carrier having opposite first and second sides. A plurality of contacts are held in the carrier. Each contact includes a first conductive element configured to be signal carrying and a second conductive element configured to be a current carrying ground. The first and second conductive elements are positioned relative to one another such that the signal and ground on each contact are electromagnetically coupled to one another such that crosstalk between adjacent contacts is minimized.

In yet another embodiment, a contact for an electrical connector is provided. The contact includes a flexible layer of insulative material having opposite inner and outer sides. The flexible layer includes a body that extends between first and second contact ends. A first conductive element on the outer side of the flexible layer extends between a first contact tip at the first contact end to a first contact tip at the second contact end. A second conductive element on the inner side of the flexible layer extends between a second contact tip at the first contact end to a second contact tip at the second contact end. The first and second conductive elements define separate electrical paths between the first and second contact ends.

DETAILED DESCRIPTION OF THE INVENTION

Figure 1:
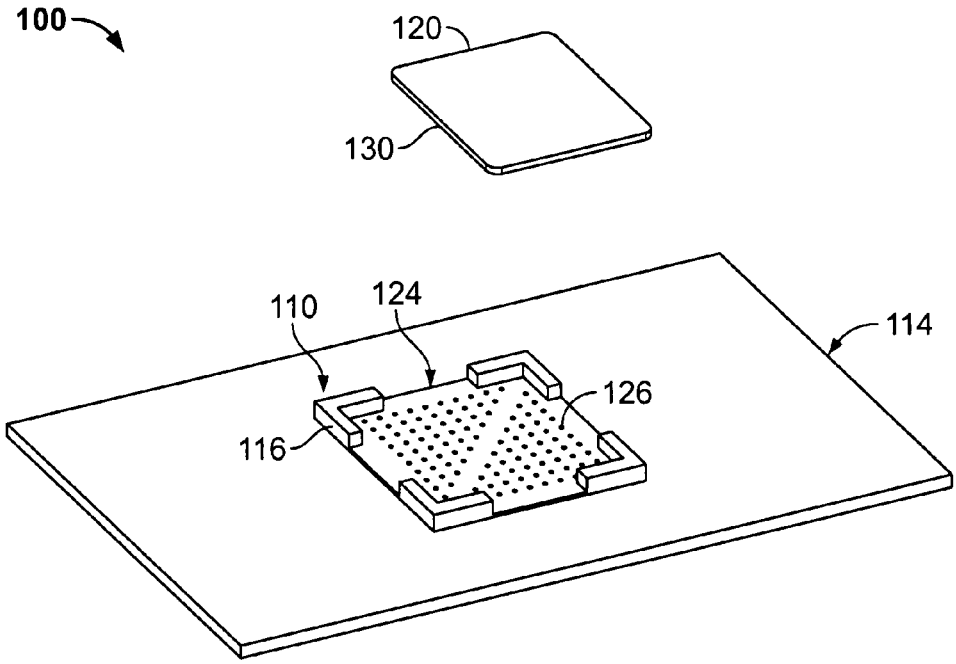
FIG. 1 is an exploded view of an electronic assembly including a connector formed in accordance with an exemplary embodiment of the present invention.

FIG. 1 illustrates an electronic assembly 100 including a connector 110 formed in accordance with an exemplary embodiment of the present invention. The connector 110 is mounted on a circuit board 114 and an electronic package 120 is loaded onto the connector 110. When loaded onto the connector 110, the electronic package 120 is electrically connected to the circuit board 114. In one embodiment, the connector 110 may be a socket connector. The electronic package 120 may be a chip or module such as, but not limited to, a central processing unit (CPU), microprocessor, or an application specific integrated circuit (ASIC), or the like.

The connector 110 includes a dielectric housing 116 that is configured to be mounted on the circuit board 114. The housing 116 holds an interconnect member 124 that includes a plurality of electrical contact assemblies 126. The electronic package 120 has a mating surface 130 that engages the interconnect member 124. The interconnect member 124 is interposed between contact pads (not shown) on the mating surface 130 of the electronic package 120 and corresponding contact pads (not shown) on the circuit board 114 to provide electrical paths to electrically connect the electronic package 120 to the circuit board 114 as will be described. It is to be understood, however, that such description is for illustrative purposes only and that no limitation is intended thereby. That is, the interconnect member 124, in other embodiments, may be used to interconnect two electrical components such as two circuit boards or two electronic packages. Further, although the interconnect member 124 is described with reference to a purely compressive interconnect member, it is to be understood that the interconnect member 124 may also be used in applications where other connection methods, such as solder connections on one or both sides of the interconnect member 124, are employed.

Figure 2:
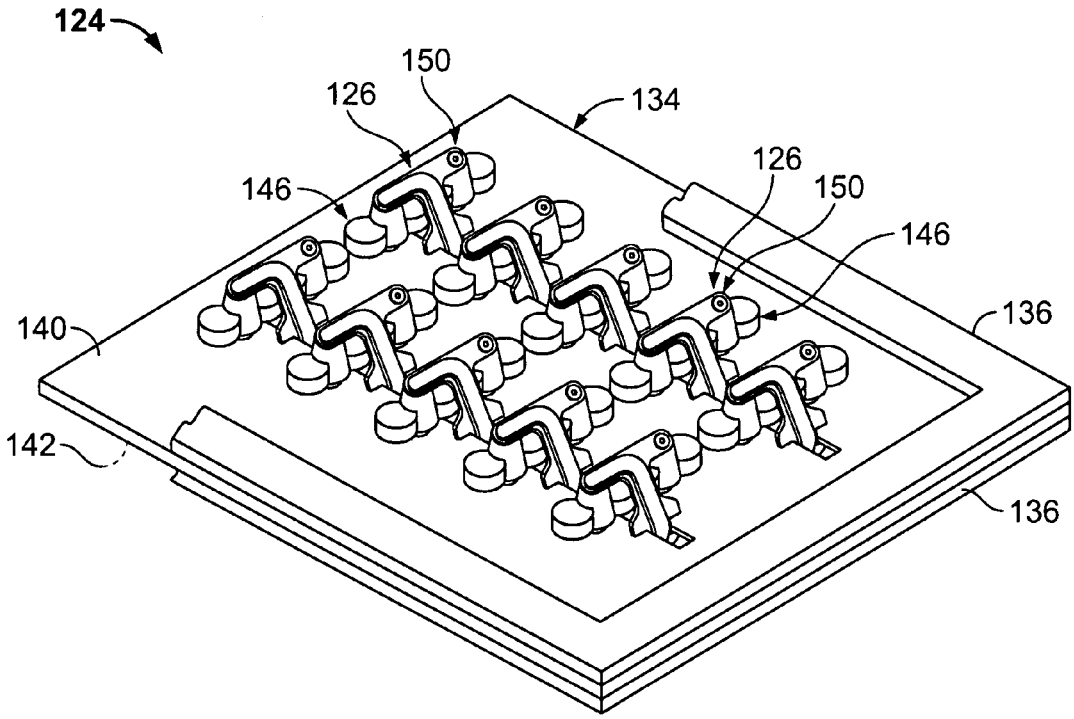
FIG. 2 is an enlarged view of a portion of an interconnect member formed in accordance with an exemplary embodiment of the present invention.

FIG. 2 illustrates an enlarged perspective view of a portion of the interconnect member 124 which is formed in accordance with an exemplary embodiment of the present invention. The interconnect member 124 includes a carrier 134 upon which the contact assemblies 126 are arranged. In one embodiment, the contact assemblies 126 are arranged on opposite sides of a diagonal (not shown) that divides the contact assemblies 126 into two contact groups. The contact assemblies 126 on opposite sides of the diagonal face each other to neutralize frictional forces on the electronic package 120 (FIG. 1) that result from the compression of the contact assemblies 126 that would otherwise tend to push the electronic package 120 toward one corner of the connector 110 (FIG. 1). In some embodiments, the carrier 134 is positioned between compression stops 136. In such embodiments, the compression stops 136 are provided to limit the compression of the contact assemblies 126 when the electronic package 120 is loaded into the connector 110.

The carrier 134 has a first side 140 and an opposite second side 142. Each contact assembly 126 includes a polymer column 146 and a contact 150, both of which are held in the carrier 134. The polymer columns 146 are positioned to align with contact pads (not shown) on the electronic package 120 (FIG. 1) and the circuit board 114 (FIG. 1). As illustrated, each of the contacts 150 spans two polymer columns 146 and is configured to electrically connect two contact pads on the electronic package 120 with two contact pads on the circuit board 114 as will be described.

Figure 3:
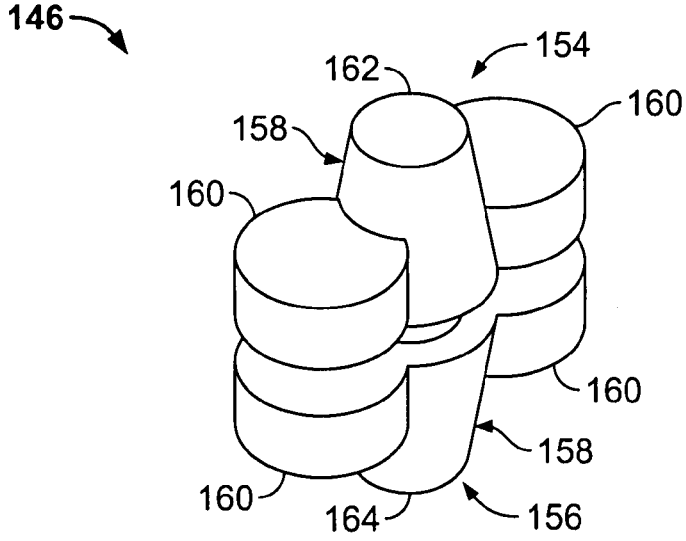
FIG. 3 is a perspective view of a polymer column shown in FIG. 2.

With continued reference to FIG. 2, FIG. 3 is a perspective view of a polymer column 146. Each polymer column 146 includes a first end 154 that extends from the first side 140 of the carrier 134 and a second end 156 that extends from the second side 142 of the carrier 134. The polymer columns 146 provide the desired mechanical properties including normal force and working range for the contact assemblies 126. The polymer column 146 includes a primary column 158 and may also include one or more secondary support columns 160. The secondary support columns 160, when present, are provided to stabilize and control the direction of compression of the primary column 158. The primary column 158 includes a first engagement end 162 that extends from the first side 140 of the carrier 134 and a second engagement end 164 that extends from the second side 142 of the carrier 134. The polymer columns 146 may be formed from either a pure polymer or a mixed polymer selected to provide desired mechanical properties. In an exemplary embodiment, the polymer columns 146 may be molded directly onto the carrier 134.

Figure 4:
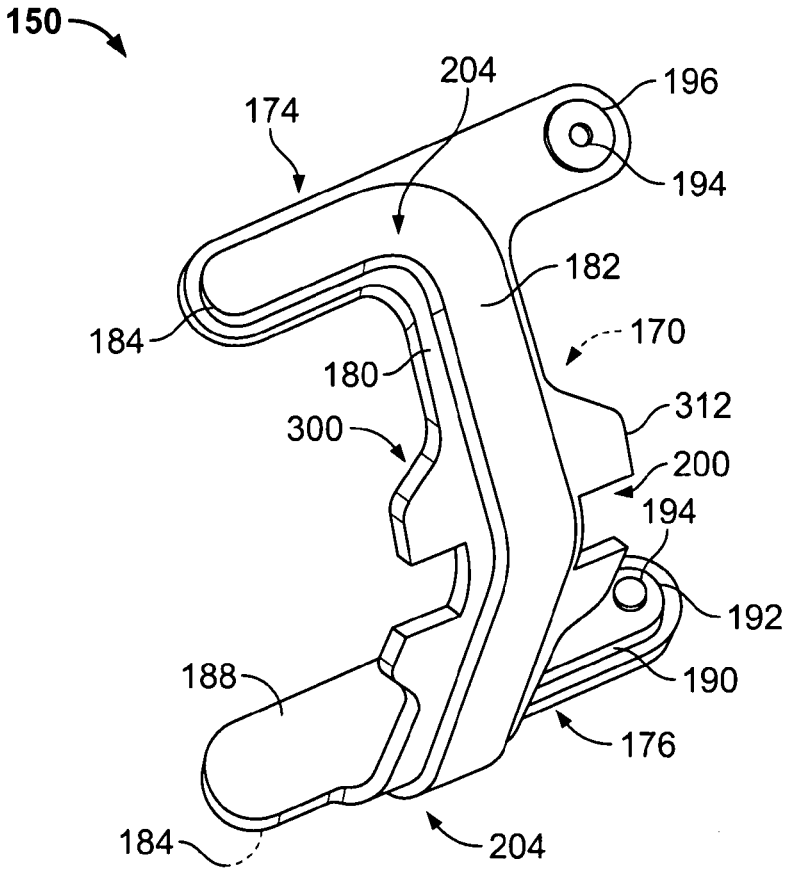
FIG. 4 is a perspective view of a contact shown in FIG. 2.
Figure 5:
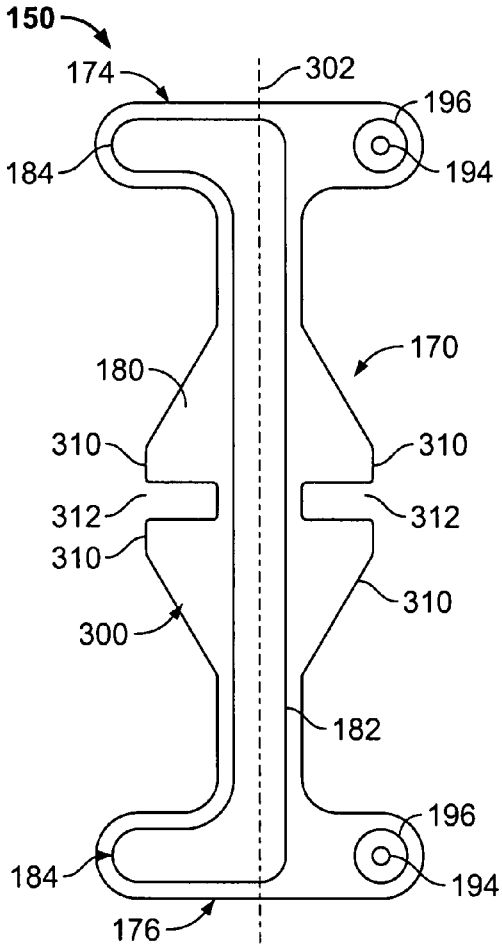
FIG. 5 is an enlarged plan view of the outer side of a contact shown in a flat state.
Figure 6:
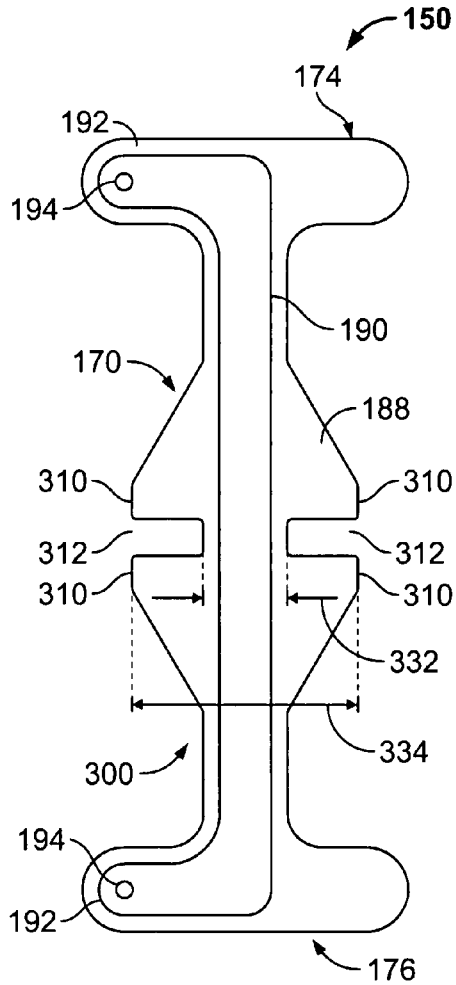
FIG. 6 is an enlarged plan view of the inner side of the contact shown in FIG. 5.

With continued reference to FIGS. 2 and 3, FIG. 4 illustrates a perspective view of a contact 150. FIG. 5 illustrates an enlarged plan view of the outer side 180 of the contact 150 shown in a flat state. FIG. 6 illustrates an enlarged plan view of the inner side 188 of the contact 150 shown in a flat state. Each contact 150 includes an elongated contact body 170 that extends between first and second opposite contact ends 174 and 176 respectively. The contact 150 includes an outer side 180 that has an outer or first conductive element 182 that defines a first conductive path between a first pair of contact tips 184 and an opposite inner side 188 that has an inner or second conductive element 190 that defines a second conductive path between a second pair of contact tips 192. The second conductive element 190 and its associated conductive path are separate from the first conductive element 182 and its associated conductive path. Vias 194 are provided at the second contact tips 192 through which electrical connectivity is established from the second conductive element 190 to the outer side 180 of the contact 150. Pad engagement elements 196 formed around the vias 194 on the outer side 180 of the contact 150 are provided for engagement with contact pads on the circuit board 114 (FIG. 1) and the electronic package 120 (FIG. 1).

The contact body 170 extends through the carrier 134 and includes a centrally located bend 200 that facilitates flexing of the contact body 170 when interposed and compressed between the electronic package 120 (FIG. 1) and the circuit board 114 (FIG. 1). The contact 150 includes bends 204 at each contact end 174 and 176 that orient the contact tips 184 and 192 for accurate registration with the contact pads (not shown in FIG. 4) on the circuit board 114 and the electronic package 120. The contact 150 is positioned and dimensioned such that the first pair of contact tips 184 are proximate the engagement ends 162 and 164 of one polymer column 146 while the second pair of contact tips 192 are proximate the engagement ends 162 and 164 of a different polymer column 146. Thusly arranged, the first conductive element 182, between the first contact tips 184, electrically connects a first pair of contact pads (not shown in FIG. 4), one on a first electrical component, i.e. the electronic package 120 and one on a second electrical component, i.e. the circuit board 114, and the second conductive element 190, between the second contact tips 192, electrically connects a second separate pair of contact pads, again, one on the electronic package 120 and one on the circuit board 114.

Turning now to FIGS. 5 and 6, the contact 150 includes a layer of a flexible insulative material 300 such as a polyimide material that includes the outer side 180 with the first conductive element 182 and the inner side 188 with the second conductive element 190. The contact body 170 extends along a longitudinal axis 302 between the contact ends 174 and 176. The contact body 170 includes a centrally located mounting portion that includes wings 310 with notches 312. The wings 310 are configured to frictionally engage the carrier 134 while allowing some degree of movement between the contact body 170 and the carrier 134. In an exemplary embodiment, the flexible layer 300 is fabricated from a flexible polyimide material. One such polyimide material is commonly known as Kaptons® which is available from E.I. du Pont de Nemours and Company. The conductive elements 182 and 190 may be formed from copper that may be etched or otherwise adhered to the flexible layer 300. After application of the conductive elements 182 and 190 to the flexible layer 300, the contacts 150 are formed to their final shape as shown in FIG. 4. Although the vias 194 are shown as extending through the flexible layer 300, the contact tips 192, and the pad engagement elements 196, it is to be understood that it is only necessary that the vias 194 extend through the flexible layer 300.

Figure 7:
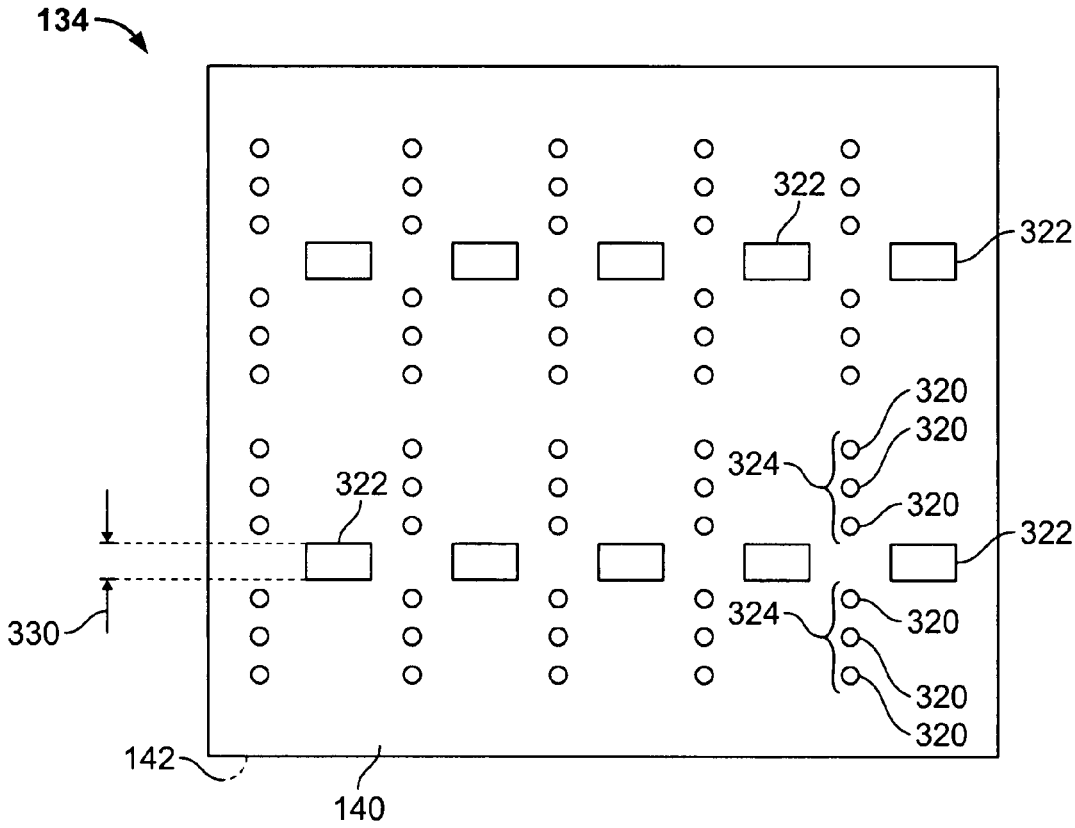
FIG. 7 is a top plan view of the carrier shown in FIG. 2.

FIG. 7 illustrates a top plan view of the carrier 134. The carrier 134 includes a plurality of apertures 320 and slots 322. The polymer columns 146 (FIG. 3) are molded onto the carrier 134 at the apertures 320. In the illustrated embodiment, the apertures 320 are arranged in groups 324 that include three of the apertures 320, with each group 324 defining a location of one polymer column 146. It is to be understood however, that other arrangements of apertures 320 are possible including more or fewer apertures 320. For instance, the apertures 320 in each group 324 may be replaced by a single aperture sized to retain one polymer column 146. Further, the apertures 320 may take geometric shape other than the circular shapes shown.

With reference to FIG. 6, each slot 322 is configured to hold a contact 150. Each slot 322 has a transverse width 330 that is sized to receive a transverse width 332 of the contact body 170 at the notches 312 while the wings 310 have a transverse width 334 that is greater than the width 330 of the slot 322. When installed in the carrier 134, the notches 312 of the contact body 170 fit within the slot 322 while the wings 310 engage the first and second sides 140 and 142 respectively of the carrier 134 so that the conductive elements 182 and 190 are isolated from the carrier 134. In an exemplary embodiment, the carrier 134 may be fabricated from stainless steel. In other embodiments, the carrier 134 may be made from an insulative material such as FR4, which is commonly used for circuit boards, or a polyimide material.

Figure 8:
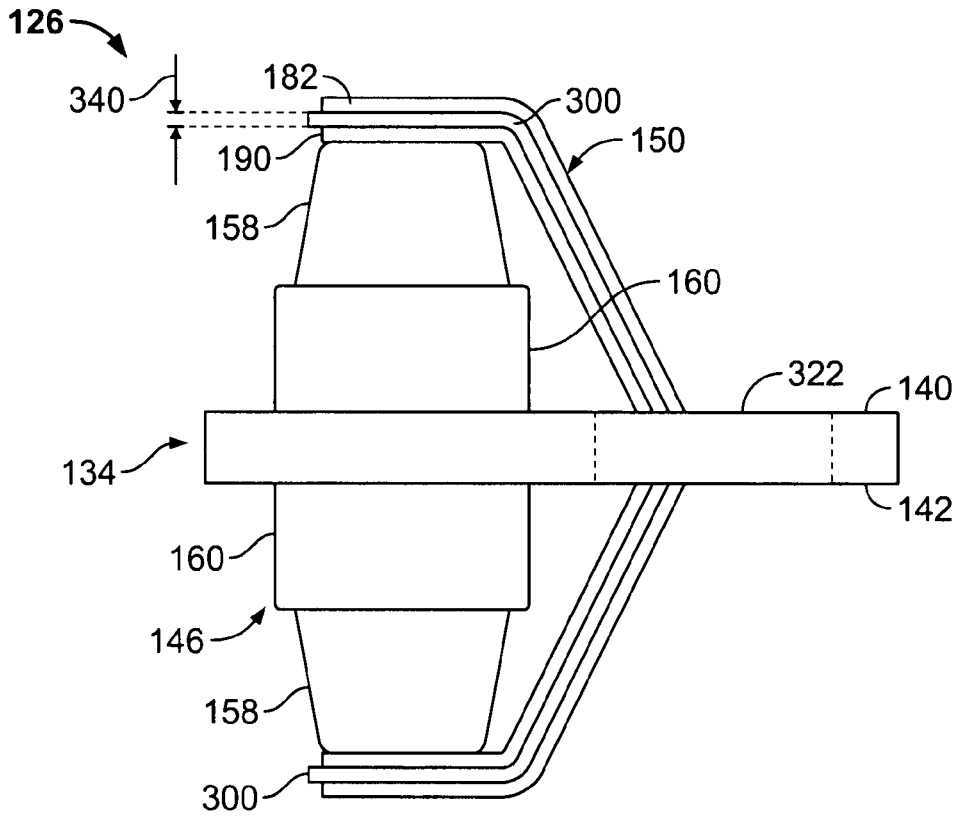
FIG. 8 is an enlarged side view of a contact assembly in an uncompressed state.
Figure 9:
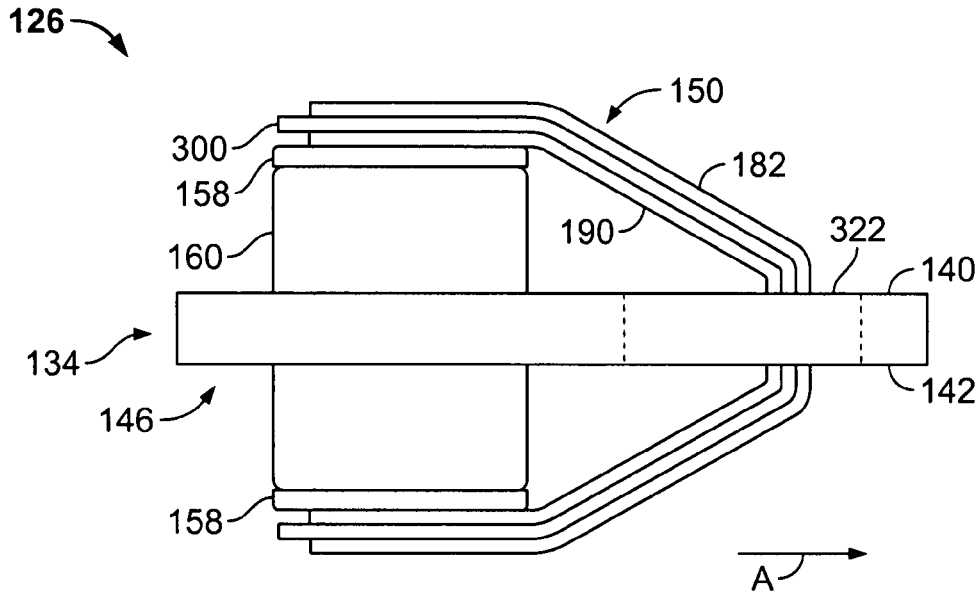
FIG. 9 is an enlarged side view of a contact assembly in a compressed state.

With reference to FIG. 4, FIG. 8 illustrates an enlarged side view of the contact assembly 126 in an uncompressed state. FIG. 9 illustrates an enlarged side view of the contact assembly 126 in a compressed state. When the contacts 150 are loaded into the carrier 134, the slots 322 in the carrier 134 provide clearance space for flexing of the contacts 150. The wings 310 frictionally engage the first and second sides 140 and 142 of the carrier 134 sufficiently to prevent the contact ends 174 and 176 from becoming disengaged from the polymer columns 146 while permitting the contact body 170 to move in the direction of the arrow A within the slot 322 to flex in response to a compressive load on the contact assembly 126. Coincident with the flexing of the contact 150, the polymer column 146, and particularly the primary column 158, is compressed in response to the compressive load on the contact assembly 126.

The flexible layer 300 of the contact 150 has a thickness 340 which represents a distance between the first conductive element 182 and the second conductive element 190. At such distances, when one of the conductive elements 182, 190 is signal carrying and the other is a ground, and particularly a current carrying ground, the signal and ground are very tightly electromagnetically coupled to one another rather than the signal being coupled to a signal carried in an adjacent contact 150 such that crosstalk introduced in the connector 110 is minimized even at high contact densities. In this manner, transmission line properties may be maintained through the connector 110 thereby preserving signal integrity through the connector 110. It is to be understood, that the widths of the first and second conductive elements 182 and 190 respectively, as well as the thickness 340 of the flexible layer 300 may be varied to optimize the noise reducing characteristics, particularly crosstalk, in the connector 110.

Figure 11:
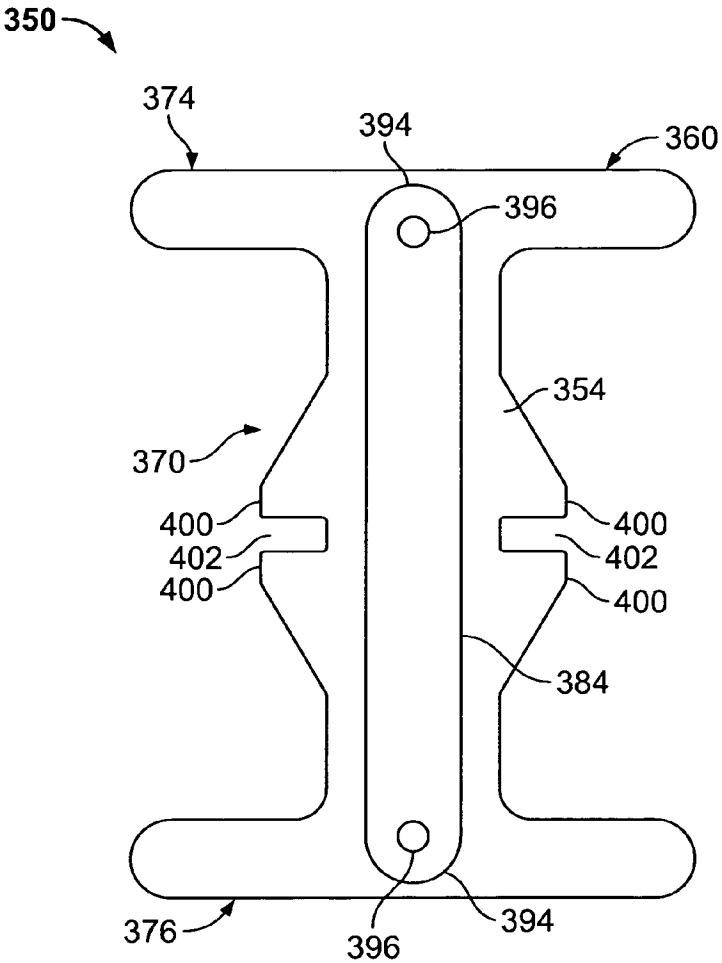
FIG. 11 is an enlarged plan view of the inner side of the contact shown in FIG. 10.
Figure 10:
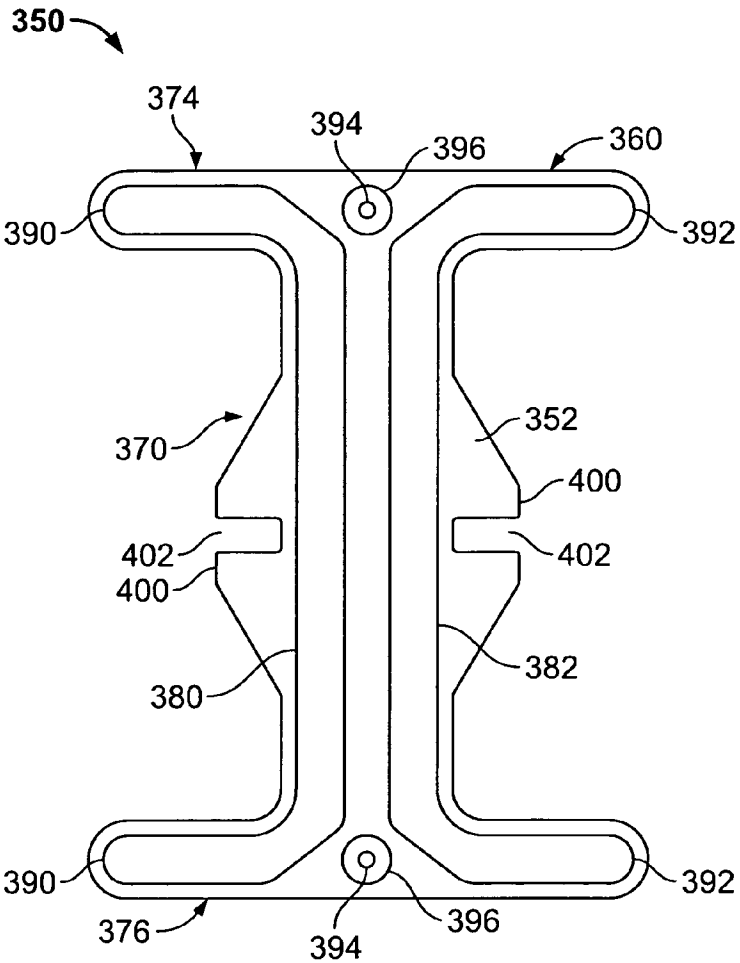
FIG. 10 is an enlarged plan view of the outer side of an alternative contact shown in a flat state.

FIG. 10 illustrates an enlarged plan view of an alternative contact 350 showing an outer side 352 in a flat state. FIG. 11 is an enlarged plan view of an opposite inner side 354 of the contact 350. The contact 350 is similar to the contact 150 previously described with the exception that the contact 350 includes an additional conductive element as described below.

The contact 350 includes a layer of a flexible insulative material 360 that includes the outer side 352 and the opposite inner side 354. The contact 350 includes an elongated contact body 370 that extends between first and second opposite contact ends 374 and 376 respectively. The contact 350 includes first and second conductive elements 380 and 382 respectively, formed on the outer side 352 of the flexible layer 360 and a third conductive element 384 formed on the inner side 354 of the flexible layer 360. The first and second conductive elements 380 and 382 define conductive paths between respective first and second pairs of contact tips 390 and 392. The third conductive element 384 defines a third conductive path between a third pair of contact tips 394. Vias 396 are provided at the third contact tips 394 through which electrical connectivity is established from the third conductive element 384 to the outer side 352 of the flexible layer 360. Wings 400 with notches 402 are provided on the contact body 370 for retaining the contact 350 in a carrier such as the carrier 134 (FIG. 7) as previously described. After application of the conductive elements 380, 382, and 384 to the flexible layer 360, the contacts 350 are formed to their final shape which is similar to that of the contact 150 as shown in FIG. 4.

With reference to FIG. 2, when loaded into a carrier, the contacts 350 are positioned such that the pairs of contact tips 390, 392, and 394 are proximate the engagement ends 162, 164 (FIG. 3) of three different polymer columns 146 to thereby provide three separate electrical connections between two electrical components, such as the electronic package 120 on one side 140 of the carrier 134 and the circuit board 114 on the opposite side 142 of the carrier 134.

In an exemplary embodiment, the conductive elements 380 and 382 may be signal carrying elements carrying differential signals and the conductive element 384 may be a ground element that may also be signal carrying. As previously described, the conductive elements 380 and 382 on the outer side 352 of the flexible layer 360 are separated from the conductive element 384 on the inner side 354 of the flexible layer 360 only by the thickness of the flexible layer 360. Due to the close proximity of the signal carrying conductive elements 380 and 382 with the ground conductive element 384, a tight electromagnetic coupling between the differential signals and ground exists such that crosstalk between the signals carried on adjacent contacts 350 is minimized.

The embodiments thus described provide a connector 110 that preserves signal integrity through the connector 110 by reducing crosstalk introduced in the connector 110. The connector 110 includes contacts 150 having at least two independent conductive elements 182, 190 on opposite sides 180, 188 of a flexible layer 300 whereby the contacts 150 provide at least two separate electrical connections between two electrical components. The conductive elements 182, 190 are separated by a thickness 340 of the flexible layer 300 such that when one conductive element is signal carrying and the other is a ground, a tight coupling between the signal and ground is achieved which minimizes the crosstalk between the signals carried on adjacent contacts 150 in the connector 110.

While the invention has been described in terms of various specific embodiments, those skilled in the art will recognize that the invention can be practiced with modification within the spirit and scope of the claims.

What is claimed is:

1. An electrical connector comprising:

a carrier having opposite first and second sides;

polymer columns held in said carrier and protruding from at least one of said first and second sides of said carrier; and a plurality of contacts held in said carrier, each said contact having opposing first and second contact ends, each said contact including a first conductive element defining a first conductive path and a second conductive element defining a second conductive path separate from said first conductive path, said first and second conductive paths configured to electrically connect an electrical component on one side of said carrier to an electrical component on said opposite side of said carrier, wherein at least one of said first and second contact ends engages a plurality of said polymer columns, further wherein said carrier includes a plurality of slots and a plurality of openings separate from said slots, each said contact mounted in one of said slots and said polymer columns mounted in said openings.

2. The electrical connector of claim 1, wherein each contact end includes first and second contact tips, said first conductive element extending between said first contact tips and said second conductive element extending between said second contact tips.

3. The electrical connector of claim 1, wherein each said contact includes an insulative layer having opposite inner and outer sides and wherein one of said conductive elements is formed on said outer side and the other of said conductive elements is formed on said inner side.

4. The electrical connector of claim 1, wherein a portion of each of said plurality of contacts is configured to move within said slot when said contact is compressed.

5. The electrical connector of claim 1, wherein one of said conductive elements is signal carrying and the other of said conductive elements is a current carrying ground.

6. The contact of claim 1, wherein said polymer columns protrude between opposing first and second polymer ends, wherein said at least one of said first and second contact ends engages a plurality of said first polymer ends or a plurality of said second polymer ends.

7. The electrical connector of claim 1 wherein each said polymer column includes a first column end extending from said first side of said carrier and a second column end extending from said second side of said carrier.

8. The electrical connector of claim 7, wherein each said polymer column includes a primary column elongated along a longitudinal axis between said first and second column ends and a secondary column elongated between opposing secondary column ends, the secondary column supporting said primary column, wherein said secondary column ends are offset from said first and second column ends of said primary column in a direction transverse to said longitudinal axis.

9. An electrical connector comprising:

a carrier having opposite first and second sides;

polymer columns held in said carrier and protruding from at least one of said first and second sides of said carrier; and a plurality of contacts held in said carrier, each said contact having opposing first and second contact ends, each said contact including a first conductive element configured to be signal carrying and a second conductive element configured to be a current carrying ground and wherein the first and second conductive elements are positioned relative to one another such that signal and ground on each contact are electromagnetically coupled to one another such that crosstalk between adjacent ones of said plurality of contacts is reduced, wherein at least one of said first and second contact ends engages a plurality of said polymer columns, further wherein said carrier includes a plurality of slots and a plurality of openings separate from said slots, each said contact mounted in one of said slots and said polymer columns mounted in said openings.

10. The electrical connector of claim 9, wherein said first and second conductive elements define separate first and second conductive paths configured to electrically connect an electrical component on one side of said carrier to an electrical component on said opposite side of said carrier.

11. The electrical connector of claim 9, wherein each contact end includes first and second contact tips, said first conductive element extending between said first contact tips and said second conductive element extending between said second contact tips.

12. The electrical connector of claim 9, wherein each said contact includes an insulative layer having opposite inner and outer sides and wherein one of said conductive elements is formed on said outer side and the other of said conductive elements is formed on said inner side, said conductive elements being separated by a distance corresponding to a thickness of said insulative layer.

13. The electrical connector of claim 9, wherein a portion of each of said plurality of contacts is configured to move within said slot when said contact is compressed.

14. The contact of claim 9, wherein said polymer columns protrude between opposing first and second polymer ends, wherein said at least one of said first and second contact ends engages a plurality of said first polymer ends or a plurality of said second polymer ends.

15. The electrical connector of claim 9 wherein each said polymer column including a first column end extending from said first side of said carrier and a second column end extending from said second side of said carrier.

16. The electrical connector of claim 15, wherein each said polymer column includes a primary column elongated along a longitudinal axis between said first and second column ends and a secondary column extending between opposing secondary column ends, the secondary column supporting said primary column, wherein said secondary column ends are offset from said first and second column ends of said primary column in a direction transverse to said longitudinal axis.

17. A contact for an electrical connector comprising:

a flexible layer of insulative material having opposite inner and outer sides, said flexible layer including a body that extends between first and second contact ends, the body including a notch between said first and second contact ends that is shaped to retain the contact in a slot of a carrier;

a first conductive element on said outer side of said flexible layer extending between a first contact tip at said first contact end to a first contact tip at said second contact end; and a second conductive element on said inner side of said flexible layer extending between a second contact tip at said first contact end to a second contact tip at said second contact end, wherein said first and second conductive elements define separate electrical paths between said first and second contact ends.

18. The contact of claim 17, wherein one of said conductive elements is configured to be signal carrying and the other of said conductive elements is configured to be a current carrying ground.

19. The contact of claim 17, wherein said first and second conductive elements are separated by a distance corresponding to a thickness of said flexible layer.

20. The contact of claim 17, wherein said body extends along a longitudinal axis between said first and second contact ends, said notch disposed transverse to said longitudinal axis.

* * * * *